United States Patent [19]

Copeland

[11] 4,198,721

[45] Apr. 22, 1980

[54] COMBINATION MOTOR AND AUXILIARY MECHANISM ACTUATOR

[75] Inventor: William M. Copeland, Hoffman Estates, Ill.

[73] Assignee: Servicemaster Industries, Inc., Downers Grove, Ill.

[21] Appl. No.: 921,213

[22] Filed: Jul. 3, 1978

[51] Int. Cl.[2] ..... A47L 11/03; H01H 3/02

[52] U.S. Cl. ..... 15/50 R; 200/61.85; 200/153 T; 200/157; 200/331

[58] Field of Search ..... 200/5 R, 5 B, 5 C, 17 R, 200/18, 50 C, 61.85, 153 T, 157, 330–331; 15/49 R, 50 R

[56] References Cited

U.S. PATENT DOCUMENTS

| | | | |
|---|---|---|---|
| 2,370,907 | 3/1945 | Lewis | 200/157 |
| 2,487,093 | 11/1949 | Bright | 200/157 |
| 2,513,718 | 7/1950 | Gfrorer | 200/157 X |
| 2,630,509 | 3/1953 | Arones | 200/330 X |
| 2,919,332 | 12/1959 | Descarries | 200/157 |
| 3,101,505 | 8/1963 | Belicka et al. | 15/50 R X |
| 3,163,725 | 12/1964 | Zeller | 200/18 |
| 3,169,410 | 2/1965 | Armandroff | 200/330 X |
| 3,411,170 | 11/1968 | Kingsley | 200/157 X |
| 3,412,415 | 11/1968 | Brab | 200/157 X |
| 3,600,100 | 8/1971 | Arones | 15/50 R X |

*Primary Examiner*—Stephen Marcus

*Attorney, Agent, or Firm*—Allegretti, Newitt, Witcoff & McAndrews

[57] ABSTRACT

An improvement of a combination motor and auxiliary cleaning mechanism actuator is included in a manually operated, rotary cleaning machine. The actuator includes an elongated actuator member mounted on the handle of the machine for movement among at least three actuator positions. The actuator member extends alongside the handle grip portion of the machine handle between two handle grips. Springs bias the actuator member to the first actuator position. Movement of the actuator member to the second actuator position places a first switch in an energizing state for energizing the motor of the machine, and movement of the actuator member to the third actuator position places a second switch in an energizing state for energizing an auxiliary cleaning mechanism of the machine.

7 Claims, 6 Drawing Figures

COMBINATION MOTOR AND AUXILIARY MECHANISM ACTUATOR

BACKGROUND OF THE INVENTION

The present invention relates to a manually operated, rotary cleaning machine, and more particularly, to an improvement in a manually operated, rotary cleaning machine of a combination motor and auxiliary cleaning mechanism actuator.

In the performance of cleaning services, i.e., rug shampooing, floor cleaning, floor waxing and the like, a variety of manually operated, rotary cleaning machines are utilized. Common components of such machines are a base assembly, having a motor which drives a rotary cleaning disc, a handle assembly and an auxiliary cleaning mechanism, i.e., a cleaning solution dispensing mechanism. In the past, typical controls for such a machine consisted of a twist grip that actuated the motor, or a pivoting lever adjacent one grip that actuated the motor, and a push button along the stem of the handle that actuated the auxiliary cleaning mechanism.

While cleaning machines having controls as described have been satisfactory, some inconvenience has existed in that the controls have been difficult to actuate during operation of the cleaning machine. That is, operators have found it difficult to reach and actuate the controls while resisting the torque created by the rotation of the cleaning disc.

SUMMARY OF THE INVENTION

In a principal aspect, the present invention is an improvement in a rotary cleaning machine of the type adapted to be operated manually for the cleaning of floors and the like. Such a machine has a base assembly including motor means, a handle grip portion with spaced handle grips, and auxiliary cleaning means.

The improvement of the present invention is a combination motor and auxiliary cleaning means actuator which comprises a substantially rigid and elongated actuator member, biasing means, first switch means and second switch means. The actuator member is mounted upon the handle assembly for movement among at least a first actuator position, a second actuator position and a third actuator position. The actuator member extends alongside the handle grip portion between the handle grips. The biasing means biases the actuator member to the first actuator position.

The first switch means and the second switch means are each operable in an energizing state and in a de-energizing state. In the energizing state, the first switch means energizes the motor means and in the energizing state, the second switch means energizes the auxiliary cleaning means. The first switch means and the second switch means are mounted on the handle so that movement of the actuator member to the second actuator position places at least the first switch means in the energizing state and movement of the actuator member to the third actuator position places at least the second switch means in the energizing state.

As preferred, the actuator member is slidably and pivotally mounted on the handle assembly. Movement of either end of the actuator member alone, toward the adjacent handle grip, places the actuator member in the second actuator position, and simultaneous movement of both ends toward the handle grips places the actuator member in the third actuator position.

It is thus an object of the present invention to provide an improvement in a manually operated, rotary cleaning machine, which is a combination motor and auxiliary cleaning mechanism actuator.

Another object of the present invention is to provide a combination motor and auxiliary cleaning mechanism actuator that provides for excellent manual control of the cleaning machine during operation of the machine.

Another object of the present invention is to provide a combination motor and auxiliary cleaning mechanism actuator which provides for actuation of both the motor and the auxiliary cleaning mechanism without release of the handle grips.

Another object of the present invention is to provide a combination motor and auxiliary cleaning mechanism actuator which provide for wide spacing of the handle grips for greater machine stability during operation.

Another object of the present invention is to provide a combination motor and auxiliary cleaning mechanism actuator which, when released, de-energizes the motor and the auxiliary cleaning mechanism.

A further object of the present invention is to provide a combination motor and auxiliary cleaning mechanism actuator which provides for actuation of the motor with either hand alone.

A further object of the present invention is to provide a combination motor and auxiliary cleaning mechanism actuator which does not, by its inclusion, weaken the handle assembly of the cleaning mechine.

A still further object of the present invention is to provide a combination motor and auxiliary cleaning mechanism actuator which is reliable and has an extended, repair-free service life.

These and other objects and advantages of the present invention will become apparent from the detailed description of the preferred embodiment, which follows.

BRIEF DESCRIPTION OF THE DRAWING

The preferred embodiment of the present invention will be described in relation to the accompanying drawing, wherein.

Figures 1, 2, 3:
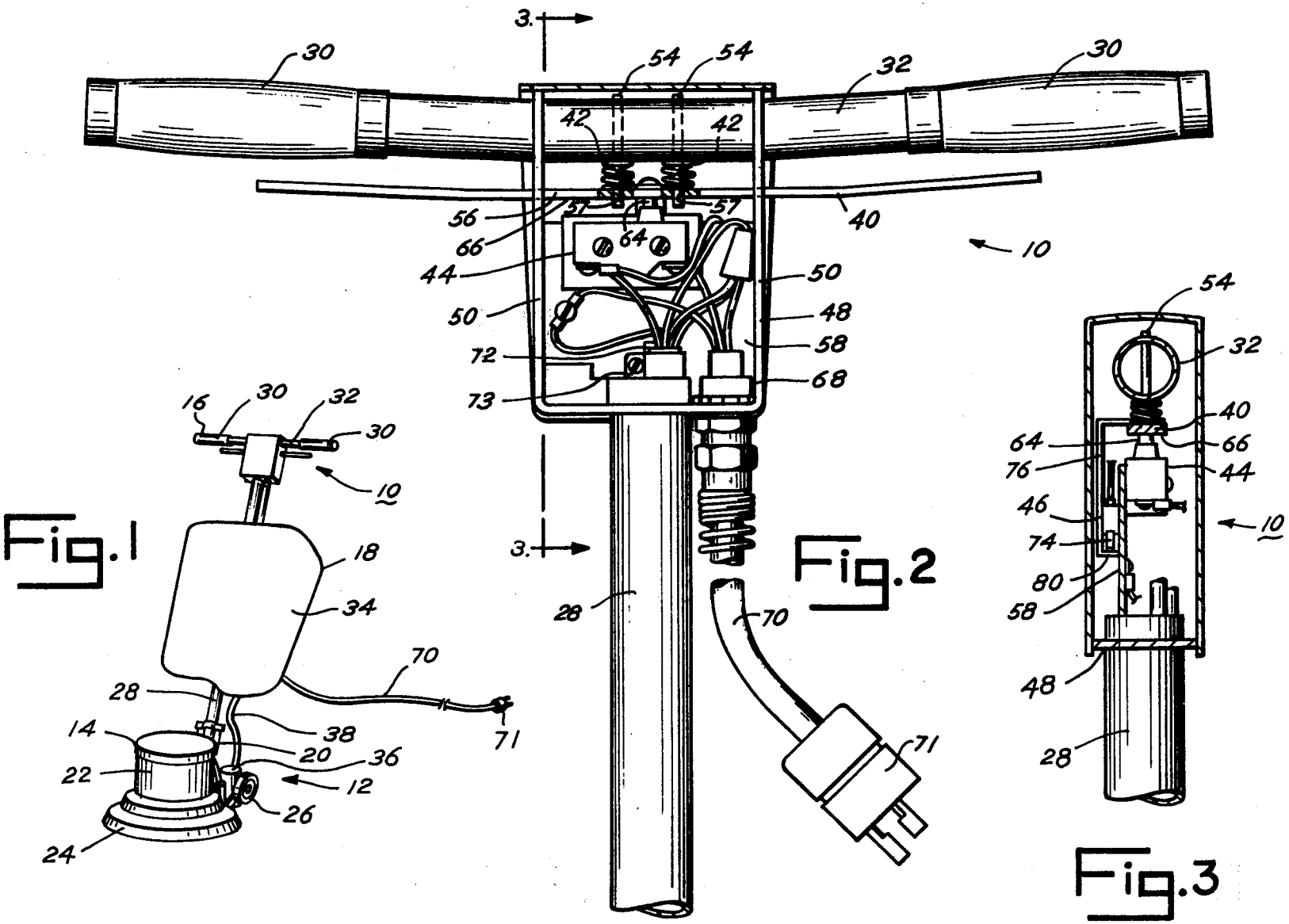
FIG. 1 is a perspective view of a typical, manually operated, rotary cleaning machine, incorporating the combination motor and auxiliary cleaning mechanism actuator of the preferred embodiment of the present invention.
FIG. 2 is an enlarged view of the upper portion of the handle assembly of the cleaning mechine of FIG. 1, with a cover plate removed to show in detail the combination motor and auxiliary cleaning mechanism actuator of FIG. 1.
FIG. 3 is a cross-sectional, side view, taken along the line 3—3 of FIG. 2.

In this brief description of the drawing, and in the detailed description of the preferred embodiment which follows, the terms "front," "rear," "side," "left," "right," and similar terms are utilized. These terms have reference to the preferred embodiment of the present invention as would appear to a person viewing the accompanying drawing.

DETAILED DESCRIPTION OF THE PREFERRED EMBODIMENT

Referring to FIG. 1, the preferred embodiment of the present invention is the improvement in a manually operated, rotary cleaning machine 10 of a combination motor and auxiliary cleaning mechanism actuator 12.

As shown in FIG. 1, for the purpose of illustration only, the machine 10 includes a base assembly 14, a handle assembly 16, and an auxiliary cleaning mechanism assembly 18. The base assembly 14 includes a housing 20 having an upper, cylindrical portion 22 and a lower, disc-like portion 24. Mounted within the cylindrical portion 22 is a conventional electric motor (not shown) having a motor shaft rotatable about a substantially vertical axis. A generally planar cleaning attachment (not shown), such as a floor polishing attachment, is removably secured to the motor shaft within the disc-like portion 24. Upon retraction of the upwardly retractable wheels 26, the cleaning attachment contacts the surface on which the machine 10 rests, through the open lower surface of the disc-like portion 24. The cleaning attachment is driven by the motor to clean a floor or the like.

A stem portion 28 of the handle assembly 16 is attached, at its lower end, to the housing 20 and is formed of a tubular steel rod. A transverse, tubular handle grip portion 32 is mounted in the upper end of the stem portion 28 at a height such that the transverse handle grip portion is within convenient and comfortable reach of a standing operator. Handle grips 30 are fitted onto the ends of the transverse portion 32 and are equi-distant from the stem portion 28. The operator of the machine 10 grasps the handle grips 30 during normal operation of the machine.

In the specific machine 10 depicted in FIG. 1, the auxiliary cleaning mechanism assembly 18 includes a tank 34 and a dispenser 36. The tank and dispenser are connected by a hose 38. The tank 34 is mounted on a mounting bracket (not shown) on the stem portion 28. The dispenser 36 is mounted on the housing 20 adjacent the lower, disc-like portion 24. The tank 34 forms a reservoir for cleaning solution or the like, and upon actuation of an electric solenoid feed value, the dispenser 36 dispenses the cleaning solution upon the floor.

Referring to FIGS. 2-6, the actuator 10 includes, briefly, an actuator member such as a trigger bar 40, bias means such as springs 42, first switch means such as a first switch 44, and second switch means such as a second switch 46.

The trigger bar 40 is formed of substantially rigid material such as steel. The trigger bar 40 is elongated, in a direction generally parallel to the handle grip portion 32, so that the trigger bar extends alongside the handle grip portion 32 and so that its ends are adjacent to the handle grips 30. As shown in FIG. 3, the trigger bar 40 is substantially rectangular in cross section.

Figure 5:
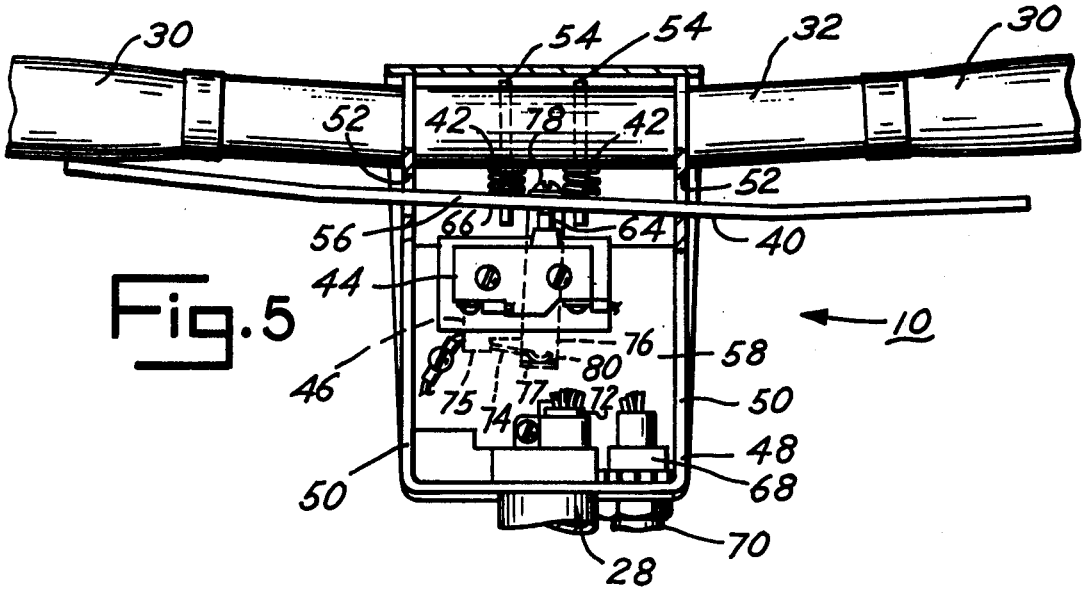
FIG. 5 is a front elevational view, similar to FIG. 2, with the actuator member of the combination motor and auxiliary cleaning mechanism actuator moved from a first actuator position to a second actuator position.
Figure 6:
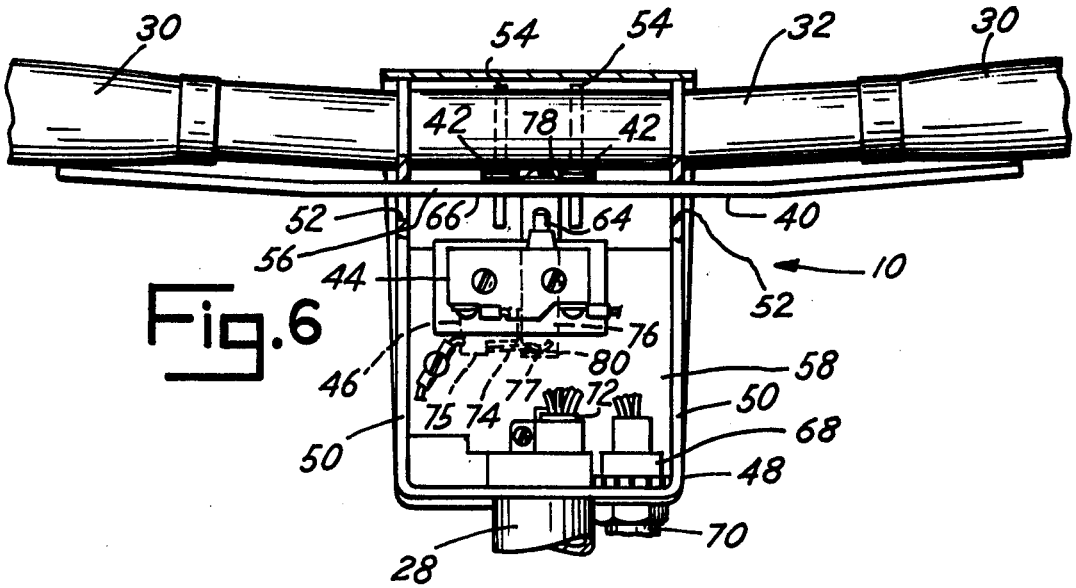
FIG. 6 is a front elevational view, similar to FIGS. 2 and 5, with the actuator member moved to a third actuator position.

The trigger bar 40 is mounted on a housing 48 that is, in turn, welded between the stem portion 28 and the handle grip portion 32. The housing 48 is a substantially rectangular box, and includes two spaced side plates 50, which are aligned with the axis of the stem portion 28. As shown in FIGS. 5-6, two slots 52 are defined in the side plates 50, and the trigger bar 40 extends through the slots 52.

Fitted through spaced, mounting holes drilled within the central portion of the handle grip portion 32 and between the side plates 50, are two roll pins 54. Defined within the central portion 56 of the trigger bar 40 are two pin holes 57 detailed in FIG. 2. The roll pins 54 pass through the pin holes 57. The slots 52, roll pins 54 and pin holes 57 cooperatively define means for guiding and limiting the movement of the trigger bar 40.

Springs 42 are helical compression springs, which abut the handle grip portion 32 and the trigger bar 40. The springs 42 bias the trigger bar 40 to a first actuator or trigger position in which the trigger bar 40 contacts the bottom edge of each slot 52.

Against the bias force of the springs 42, the trigger bar 40 is movable within the slots 52. As can be seen by comparing FIGS. 5 and 6 with FIG. 4, the trigger bar 40 is movable from the first trigger position to a second actuator or trigger position, shown in FIG. 5, and a third actuator or trigger position, shown in FIG. 6. In the second trigger position, one end of the trigger bar 40 is raised from the lower edge of a slot 52 while the other end generally remains in contact with the lower edge of the other slot 52. In the third trigger position, both ends of the trigger bar 40 are raised from the lower edges of the slots 52. While the trigger bar 40 is shown in FIG. 5 in the second trigger position with the left end raised, the trigger bar 40 is also movable to the second trigger position with the right end raised.

With his or her hands comfortably placed on the handle grips 30, an operator of the machine 10 can move the trigger lever 40 to the second trigger position using the index finger of either hand, and can move the trigger bar 40 to the third trigger position using both index fingers. Because the ends of the trigger bar 40 extend to adjacent the midpoint of the handle grips 30, the operator may place his hands at the outer ends of the handle grips 30, and still readily operate the trigger bar 40.

Referring again to FIG. 3, a switch mounting plate 58 is welded between the housing side plates 50 atop the stem portion 28. The first switch 44 is bolted to the front surface of the switch mounting plate 58. The second switch 46 is bolted to the back surface of the switch mounting plate 58.

The first switch member 44 is positioned between the side plates 50 so that a movable switch member such as button 64 of the first switch 44 projects upward between the roll pins 54. The button 64 is movable between an extended or upward position and a retracted or lowered position. In the first position of the trigger bar 40, the lower surface 66 of the trigger bar 40 contacts the button 64 and pushes the button 64 to its retracted position. In the second and third positions of the trigger bar 40, the button 64 is in its extended position.

The first switch 44 is operable between two switching states in response to movement of the button 64. In the retracted position of the button 64, the first switch 44 is in a de-energizing state. In the extended position of the button 64, the first switch 44 is in an energizing state.

As shown in FIG. 2, the first switch 44 is wired to control the operation of the machine motor. That is, the first switch is wired in series with the motor. Wires to the first switch 44 and the motor enter the housing 48 through a conduit 68 and wires leading to the motor exit the housing 48 through a wiring cable 72 held within the tubular stem portion 28 by a clamp 73. An electrical cord 70 is attached to the conduit 68, and a conventional electrical plug 71 is attached to the distal end of the cord 70.

As should be apparent, in the de-energizing state, the first switch 44 de-energizes the motor. In the energizing state, the first switch 44 energizes the motor. The motor is thus energized by moving the trigger bar 40 to the second or third trigger positions and de-energized by releasing the trigger bar 40 so that it returns to the first trigger position.

As most preferred, the first switch 44 is a switch readily available from a manufacturer of electrical components. For example, the first switch 44 may be a switch manufactured by Robertshaw Controls Corporation of Columbus, Ohio, Model No. 270-001200-FAC2-40-IS.

Referring now to FIGS. 3–6, the second switch 46 is positioned on the switch mounting plate 58 slightly below the first switch 44. A switch lever 74 of the second switch 46 extends inward from its point of attachment 75 to the midpoint between the side plate 50. A switch actuating flange 76 is attached, as by a screw 78, to the upper surface of the central portion of the trigger bar 40. The flange 76 extends downward toward the switch lever 74. As shown in FIG. 3, the flange 76 includes an inwardly extending section 80 that passes under the free end 77 of the switch lever 74.

Figure 4:
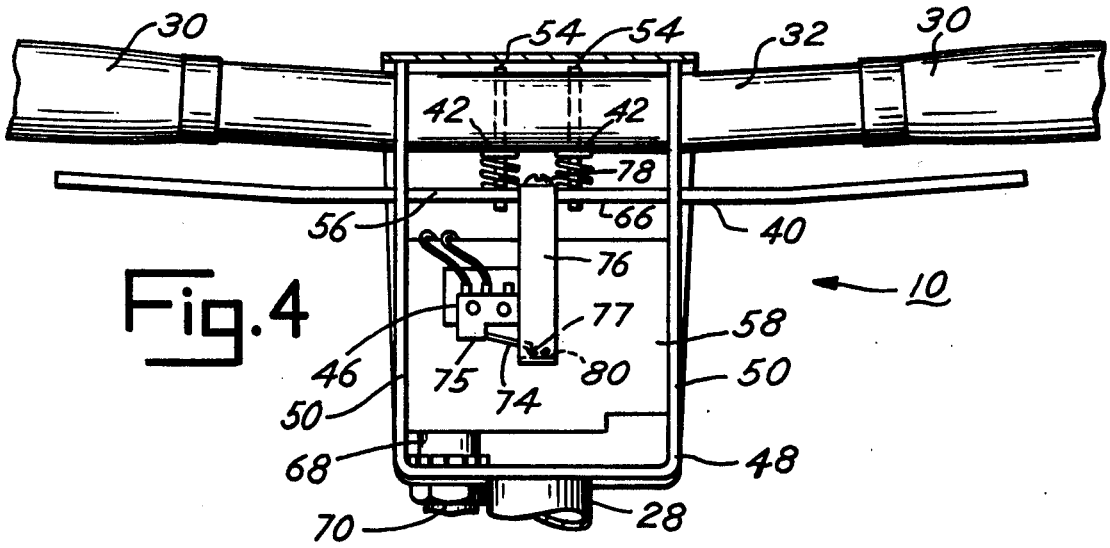
FIG. 4 is a rear elevational view, similar to FIG. 2.

The switch lever 74 is movable between a lowered position, as shown in FIG. 4, and a raised position, as shown in FIG. 6. When the trigger bar 40 is in the first trigger position, the free end 77 of the switch lever 74 rests against the section 80 and the switch lever 74 is in the lowered position. When the trigger bar 40 is in the third trigger position, the section 80 raises the switch lever 74 to the raised position. The switch lever 74 is partially raised to a position between the raised position and the lowered position when the trigger bar 40 is in the second trigger position.

The second switch 46 is operable in a de-energizing state and an energizing state, in response to movement of the switch lever 74. In the raised position of the switch lever 74, the second switch 46 is in the energizing state. In all other positions of the switch lever 74, the second switch 46 is in the de-energizing state.

As with the first switch 44, the second switch 46 is wired in series with the electrically actuated dispenser 36. Movement of the trigger bar 40 to the third trigger position thus actuates the dispenser 36, while movement of the trigger 40 to the first and second trigger positions de-energizes the dispenser 36.

Also as with the first switch 44, the second switch 46 is preferably a component readily available from a manufacturer of electrical components. The second switch 46 is also available from Robertshaw Controls Corporation, Catalog No. 3115M605-174.

From the foregoing, it should be apparent to those of skill in the art that a highly useful improvement in a manually operated, rotary cleaning machine has been disclosed. It will also be apparent that the actuator 10 of the preferred embodiment may be modified, to satisfy specific desires. The preferred embodiment of the present invention is thus to be considered illustrative and not restrictive. The scope of the present invention is to be measured by the appended claims, rather than the foregoing detailed description.

What is claimed is:

1. In a manually operated rotary cleaning machine of the type having a base assembly, a handle assembly and at least one auxiliary cleaning mechanism, said base assembly including motor means and said handle assembly including a handle grip portion with spaced handle grips, the improvement of a combination motor means and auxiliary cleaning means actuator comprising:

a substantially rigid, elongated actuator member mounted on said handle assembly for movement to at lease a first actuator position, a second actuator position, and a third actuator position, said actuator member extending alongside said handle grip portion between said handle grips and having two free ends, each of said free ends adjacent a handle grip, said actuator member movable from said first actuator position to said second actuator position upon movement of either of said two free ends and movable to said third actuator positon from said first actuator positon only upon movement of both of said free ends;

means for biasing said actuator member to said first actuator position, said bias means mounted on said handle assembly;

first switch means operable in an energizing state for energizing said motor means and operable in a de-energizing state for de-energizing said motor means, said first switch means operably connected to said motor means; and at least one second switch means operable in an energizing state for energizing said auxiliary cleaning means and operable in a de-energizing state for de-energizing said auxiliary cleaning means, said second switch means operably connected to said auxiliary cleaning means;

said first switch means and said second switch means mounted on said handle assembly so that movement of said actuator member to said second actuator position places at least said first switch means in said energizing state and movement of said actuator member to said third actuator position places at least said second switch means in said energizing state.

2. An improvement as claimed in claim 1 wherein movement of said actuator member to said second position places only said first switch means in said energizing state.

3. An improvement as claimed in claim 1 wherein movement of said actuator member to said third actuator position places both said first switch means and said second switch means in said energizing state.

4. An improvement as claimed in claim 1 wherein said second switch means includes a second switch member movable between an energizing position and a de-energizing position, said actuator member in said first actuator position maintaining said second switch member in said de-energizing position, said second switch member moving to said energizing position upon movement of said actuator member to said third actuator position.

5. An improvement as claimed in claim 4 wherein said second switch member is mounted away from said actuator member, said actuator member including a flange extending to cooperate with said second switch member.

6. An improvement as claimed in claim 1 wherein said actuator member, on movement from said first actuator position to said second actuator position, is movable towards said handle grip portion; and wherein said actuator member, on movement from said first actuator position and from said second actuator position to said third actuator position is movable toward said handle grip portion.

7. An improvement as claimed in claim 1 wherein said handle defines two spaced parallel slots, and two guide pins are mounted on said handle, said actuator member having pin holes for said guide pins, said actuator member passing through said slots and slidably mounted on said guide pins, wherein said actuator member includes two free ends, said actuator member movable to said second actuator position upon sliding movement of either of said two free ends and movable to said third actuator position only upon sliding movement of both of said free ends.

* * * * *